United States Patent [19]

Loewy et al.

[11] 4,135,718

[45] Jan. 23, 1979

[54] TOY GLIDER AND TARGET GAME

[76] Inventors: Thomas R. Loewy, 1746 Loma Dr., Camarillo, Calif. 93010; Pat R. Tuttle, 6902 Laurelhurst, Huntington Beach, Calif. 92647

[21] Appl. No.: 814,461

[22] Filed: Jul. 11, 1977

[51] Int. Cl.[2] ..... G09B 67/00; A63H 27/00

[52] U.S. Cl. ..... 273/95 B; 46/80

[58] Field of Search ..... 273/95 B; 46/79, 80, 46/81; 244/16, 154

[56] References Cited

U.S. PATENT DOCUMENTS

| | | | |
|---|---|---|---|
| 2,275,094 | 3/1942 | Taylor | 46/79 |
| 2,634,127 | 4/1953 | Shapiro | 273/95 B |
| 3,010,250 | 11/1961 | Huston, Jr. | 46/79 |

*Primary Examiner*—William H. Grieb
*Attorney, Agent, or Firm*—Lyon & Lyon

[57] ABSTRACT

Disclosed herein is a toy glider having an elongated fuselage, upper and lower wings carried by the fuselage and a tunnel member slidably mounted on the fuselage for guiding the glider and providing supplemental lift to maintain a desired in-flight pitch. In playing the target game, the glider is directed by the player at a designated object goal which is surrounded by a plurality of secondary targets bearing game scoring indicia thereon. The game is won by the glider striking the designated object goal or, alternatively, a prescribed number of secondary targets and accumulating a given winning score.

15 Claims, 5 Drawing Figures

TOY GLIDER AND TARGET GAME

BACKGROUND OF THE INVENTION

Toy gliders have been popular for many years and almost everyone at one time or another has constructed and flown a toy glider. The most well known are generally homemade and constructed simply of folded paper. While such gliders have proved to be very popular primarily due to their inexpensive construction, they have quite limited use for a short period of time as the constant bending, pulling apart and reforming of the plane rapidly deteriorates its lifting capabilities. Furthermore, the number of enjoyable games which can be played with such gliders is quite restricted due to their generally irratic flight and the vast differences in flying characteristics between seemingly similar planes.

While more elaborate gliders are commercially available which have considerably more dependable and controllable flight patterns, they are generally expensive, difficult to assemble and lack in durability. Accordingly, apart from use from experienced flyers under controlled conditions, such gliders have also proved relatively unsuited for glider related games. It would therefore be highly desirable to provide a toy glider which is of relatively economic and simple construction and capable of predetermined and controlled flight as such a glider would be highly suited for use in a controlled glider related game and accordingly provide an educational as well as an enjoyable toy.

SUMMARY OF THE INVENTION

Briefly, the present invention relates to a toy glider which is capable of a highly controlled flat trojectory flight over variable distances and a game incorporating the controlled flight characteristics of the glider for striking one or more designated targets.

It is the principal object of the present invention to provide a toy glider capable of highly controlled flight along a flat trajectory.

It is another object of the present invention to provide a toy glider which is of relatively simple construction and economical to manufacture.

It is still a further object of the present invention to provide a glider target game which utilizes controlled flight characteristics of the glider during play.

These and other objects and advantages of the present invention will become apparent from the following detailed description taken in conjunction with the accompanying drawings.

DESCRIPTION OF THE PREFERRED EMBODIMENT

IN THE DRAWINGS

Figure 1:
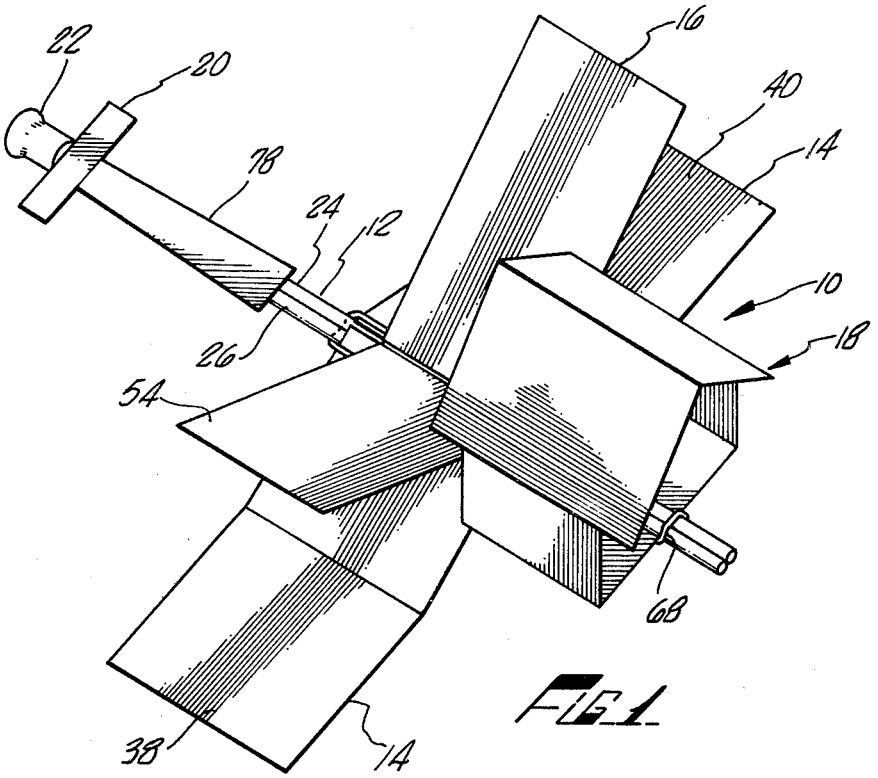
FIG. 1 is a perspective view of the glider.

Referring now in detail to the drawings, the glider 10 is comprised of a split fuselage section 12, a lower wing 14, an upper wing 16, and an tunnel member 18, a front stabilizer 20 and a nose cone 22. The fuselage section 12 is comprised of a pair of adjacent rails 24 and 26 which are preferably constructed of A.B.S. plastic or other rigid plastic material of similar specific weight. Alternatively, the rails could be constructed of a lightweight wood such as balsa wood.

Figure 3:
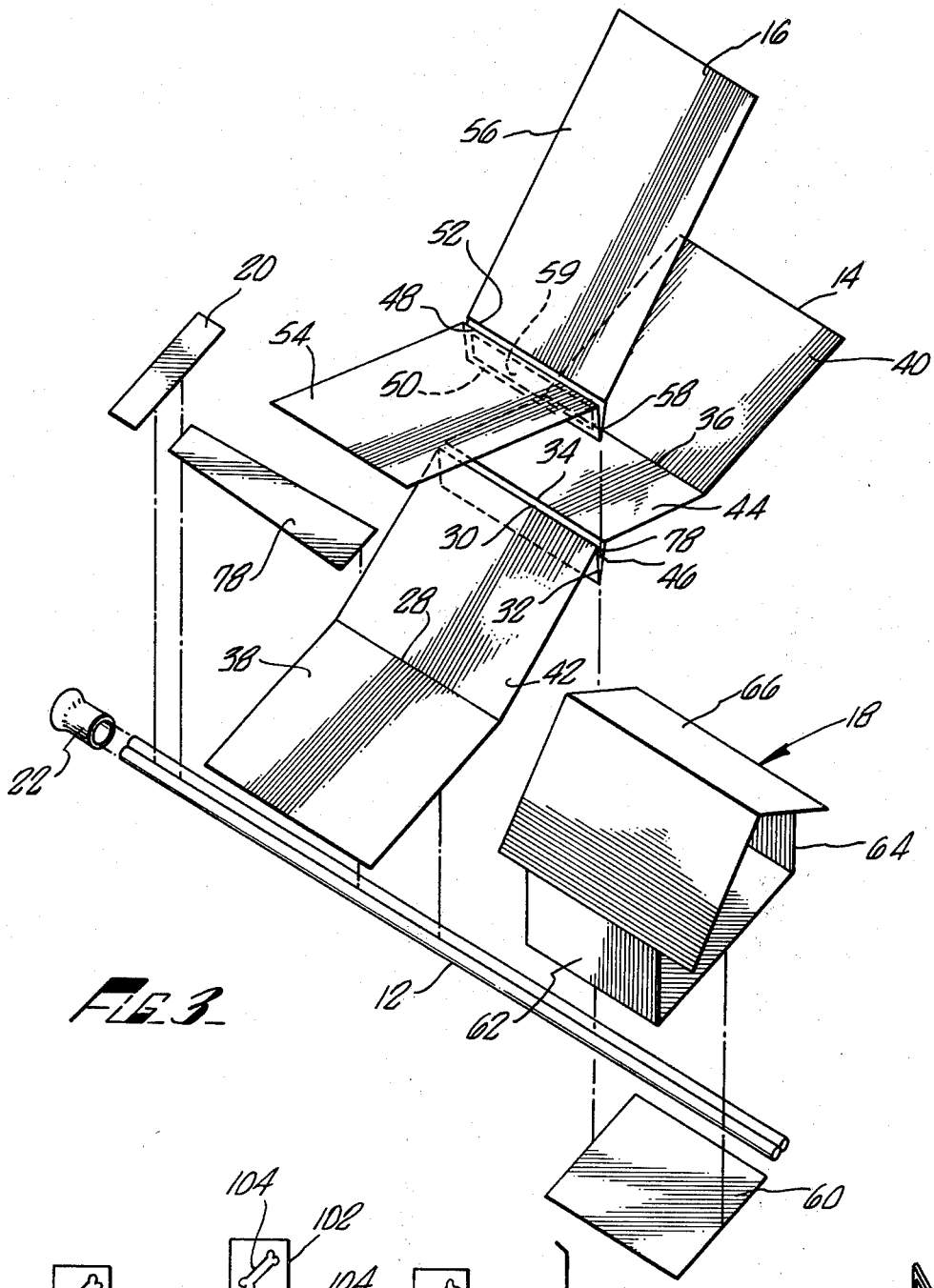
FIG. 3 is an exploded view of the glider.

The upper and lower wings are preferably constructed of 8, 9 or 10 point cardboard but lightweight polystyrene could also be used. As seen in FIG. 3, the lower wing 14 has folds at 28, 30, 32, 34 and 36 to define a pair of substantially flat extended surfaces 38 and 40, interior sloping surfaces 42 and 44 and a central downwardly extending rib portion 46. The upper wing 16 is folded at 48, 50 and 52 to define outwardly and upwardly extending wing surfaces 54 and 56 and a downwardly extending rib portion 58.

The tunnel member 18 which functions as a stationary rudder while providing supplemental lift to maintain the glider 10 at a proper pitch during flight is comprised of a supporting base portion 60, wall portions 62 and 64 and upper surface 66. In the embodiment of the tunnel member illustrated in the drawings, the upper surface 66 is shown in the configuration of a sloped roof such that the tunnel member 18 presents the appearance of a dog house and thereby coordinates the configuration of the glider with the particular theme of the target game. The tunnel member 18 could also be in the configuration of a circle or other polygon to present different appearances for different game themes, provided the member defines a tunnel configuration to provide the desired stability and supplemental lift.

Figure 2:
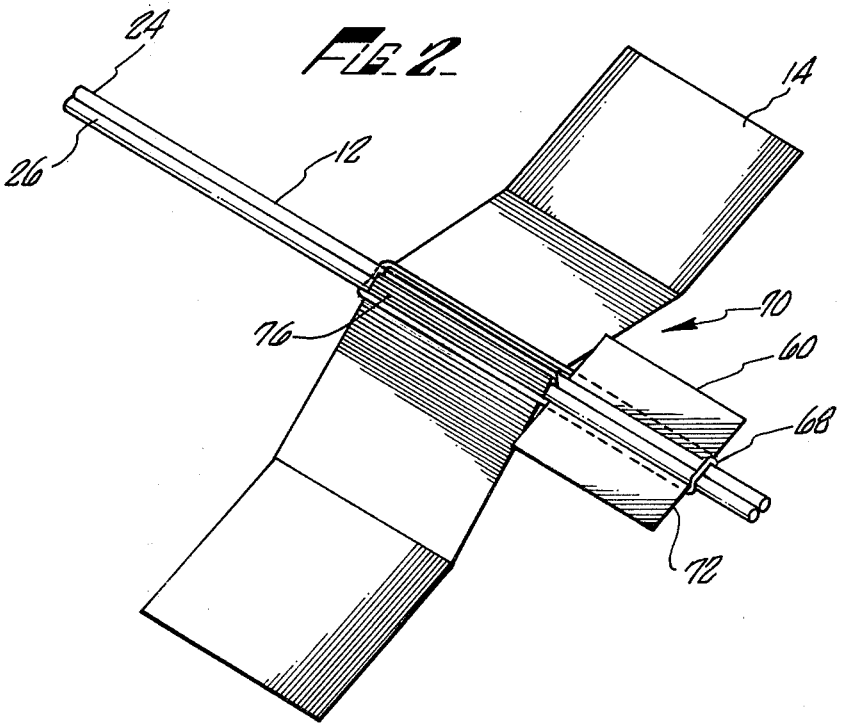
FIG. 2 is a perspective view of the fuselage, wing and tunnel member interlock assembly.

The lower wing 14 and tunnel member 18 are secured to the split fuselage 12 by means of a rubber band 68 as illustrated in FIG. 2 to define a fuselage, wing and tunnel member interlock assembly 70. As best seen in FIGS. 2 and 3, the central rib portion 46 of the lower wing is extended between the rails 24 and 26 of the fuselage section 12, the tunnel member 18 is disposed over the fuselage assembly rearwardly adjacent the lower wing 14 and the rubber band 68 is placed over the fuselage section 12 adjacent the rearward end 72 of the base portion 60 of the tunnel member 18 and under the fuselage section adjacent the forward end 74 of the lower wing 14. In addition to holding the lower wing and tunnel assembly to the fuselage section, the rubber band 68 also forms a portion 76 of the lower wing into an air foil to increase the lift to weight ratio of the glider. The upper wing 16 is then secured to the interlock assembly 70 by inserting the downwardly extending rib portion 58 thereof into the channel 78 defined by the rib portion 46 of the lower wing (see FIG. 3). The upper wing is then held in place by the lateral force exerted by the rails 24 and 26 of the fuselage against the downwardly extending rib portion 58 of the upper wing. If desired, an adhesive strip 59 can be provided on the rib portion 58 to further secure the upper wing 16 to the lower wing 14 and reduce the posibility of displacement during flight.

The glider 10 is also provided with a substantially flat forward stabilizing member 20 which is carried by the fuselage, a nose cone 22 which is disposed about the forward end of the fuselage to provide additional strength and aerodynamic balance for the glider and a fuselage shroud 78 which enhances the appearance of the glider. The front stabilizer and fuselage shroud could be of the same material as the upper and lower wing while the nose cone could be constructed of any desired flexible and resilient material such as a plastic or rubber material.

The target glider 10 of the present invention is small in size with a relatively large weight to size ratio. However, the configuration of the glider provides substantial aerodynamic lift for extended flight in a predictably flat or straight trajectory. In addition to providing this flat trajectory, the wing assembly and tunnel member 18 are slidably adjusted along the fuselage section 12 to vary the range of the glider between about 5 to 30 feet. As the wing assembly and tunnel member are moved forwardly along the fuselage, the range of the glider is correspondingly decreased, while rearward movement thereof increases the range of the glider. This combination of a predictably flat trajectory and variable range makes the glider 10 highly suited for use in a target game.

The target game of the present invention is comprised of the glider 10, an object goal 100 and a plurality of secondary targets 102 which are deployed about the object goal. The game is played by the players, in turn, directing the glider toward the object goal in an attempt to strike the object goal and thereby win the game. In the preferred embodiment of the game, the secondary targets are divided into two groups. The first or primary group has scoring indicia 104 thereon while the second group bears a penalty indicia 106. In addition to striking the object goal 100, the target game can also be won by a player directing the glider against a sufficient number of secondary targets bearing scoring indicia 104 to accumulate a game winning score. Should the glider contact one of the secondary targets having penalty indicating indicia 106 thereon, the player suffers the indicated penalty, e.g., loss of turn or elimination from the game. In the game illustrated in the drawings, the theme of the game utilizes a dog and coordinated objects to illustrate the dogfighter concept. Accordingly, the tunnel member 18 is in a dog house configuration. The object goal 100 is in the form of a fire hydrant and the secondary targets have bones and dog catchers displayed thereon as the scoring indicia and penalty indicating indicia respectively.

Figure 4:
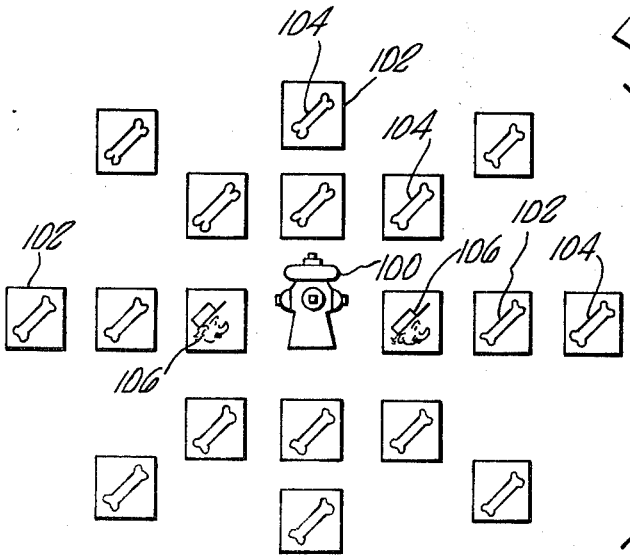
FIG. 4 is a diagrammatic view of the object goal and secondary targets employed in the glider target game of the present invention.
Figure 5:
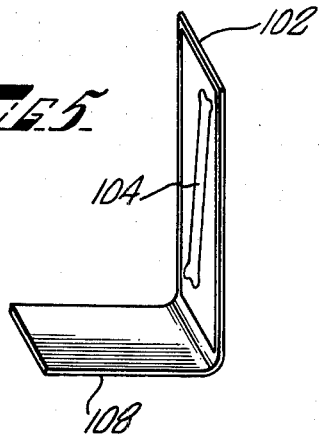
FIG. 5 is a side view of one of the secondary targets.

FIG. 4 illustrates an example of a game layout employing the aforesaid dogfighter concept. Each of the secondary targets and object goal can be constructed of cardboard and can be provided with a base 108 or other supporting means for vertical positioning in a flight path. In an alternate construction, the targets could lie flat on a horizontal plane. The targets can be spaced apart at a distance of about 12 inches and span an area of about six feet. If desired, a second group of targets could be employed at the opposite end of the playing area. The very flat trajectory of the glider 10 and its adjustable range makes it particularly suited for the above game.

Various changes and modifications may be made in carrying out the present invention without departing from the spirit and scope thereof. Insofar as these changes and modifications are within the purview of the appended claims they are to be considered as part of the present invention.

We claim:

1. A toy glider comprising an elongated fuselage, a first wing member carried by said fuselage, a second wing member carried by said fuselage and disposed above said first wing member, an open ended tunnel member carried by said fuselage rearwardly of said first and second wing members for guiding said glider and maintaining a desired pitch while said glider is in flight, said first and second wing members and said tunnel members being slidably mounted on said fuselage for adjusting the position of said wing members and said tunnel members on said fuselage thereby varying the range of said glider, and a forward horizontal stabilizer mounted on said fuselage forward of said first and second wing members, said stabilizer defining a pair of horizontal portions extending outwardly from said fuselage.

2. The combination of claim 1 wherein said first and second wing members and said tunnel member are adjustably mounted along said fuselage for varying the range of said glider.

3. The combination of claim 1 including a forward horizontal stabilizer transversely mounted on said fuselage forwardly of said first and second wing members.

4. The combination of claim 1 wherein said first wing member defines a pair of extended substantially horizontal portions and a pair of sloped portions extending inwardly and upwardly therefrom and said second wing member defines a pair of sloped portions extending downwardly from the extended ends thereof.

5. A top glider comprising an elongated fuselage at least a portion thereof being bifurcated to define a pair of rail portions and an elongated slot extending therebetween, a first wing member, a portion of said wing member being folded to define a rib portion, said rib portion being disposed within said elongated slot between said rail portions of said fuselage, a second wing member disposed above said first wing member, a portion of said second wing member being folded to define a rib portion, said rib portion being disposed within said elongated slot between said rails in said fuselage, means for urging said rail portions of said fuselage against said rib portion of said first and second wing members thereby securing said first and second wing members to said fuselage and an open ended tunnel member carried by said fuselage rearwardly of said first and second wing members for guiding said glider and maintaining a desired pitch while said glider is in flight.

6. The combination of claim 5 wherein said urging means is adjustably mounted on said fuselage for varying the positioning of said first and second wing members and said tunnel member along said fuselage for varying the range of said glider.

7. The combination of claim 5 including a forward horizontal stabilizer transversely mounted on said fuselage forwardly of said first and second wing members.

8. The combination of claim 5 wherein said first wing member defines a pair of extended substantially horizontal portions and a pair of sloped portions extending inwardly and upwardly therefrom and said second wing members define a pair of sloped portions extending downwardly from the extended ends thereof.

9. The combination of claim 5 wherein said holding means forms a portion of said first wing member into an air foil for providing an additional lift for said glider.

10. A toy glider comprising an elongated fuselage comprised of a pair of rail portions, a first wing member having a plurality of folds therein defining a pair of extended substantially horizontal portions, a pair of sloped portions extending inwardly and upwardly therefrom and a channeled central rib portion, said rib portion being disposed between said rail portions of said fuselage, a second wing member having a plurality of folds therein defining a pair of sloped portions extending downwardly from the extended ends thereof and a central rib portion, said rib portion extending into the channel defined by said rib portion of said first wing member between said rail portions of said fuselage, a forward horizontal stabilizer transversely mounted on said fuselage forwardly of said first and second wing members, means for urging said rail portions of said fuselage against said rib portion of said first wing member thereby securing said first and second wing members to said fuselage, and an open ended tunnel member carried by said fuselage rearwardly of said first and second wing members for guiding said glider and maintaining a desired pitch while said glider is in flight.

11. The combination of claim 10 wherein said urging means forms a portion of said first wing member into an air foil for providing additional lift for said glider.

12. The combination of claim 10 wherein said urging means comprises a rubber band extending over said fuselage adjacent the rearward end thereof, under said tunnel member, over said sloped portions of said first wing member and under said fuselage adjacent the forward edge of said wing member.

13. A target glider game comprising a glider having an elongated fuselage, at least a portion of said fuselage being bifurcated to define a pair of rail portions and an elongated slot extending therebetween, a first wing member, a portion of said first wing member being disposed within said elongated slot, a second wing member disposed above said first wing member, a portion of said second wing member being disposed within said elongated slot, means for urging said rail portions of said fuselage against said portions of said first and second wing members thereby securing said first and second wing members to said fuselage, and an open ended tunnel member carried by said fuselage rearwardly of said first and second wing members, said wing members and said tunnel member providing said glider with a substantially flat trajectory; an object goal; and a plurality of secondary targets, a number of said secondary targets having game scoring indicia thereon.

14. The combination of claim 13 wherein a second number of said secondary targets have a penalty indicating indicia thereon.

15. The combination of claim 14 wherein the indicia on said secondary targets generically relate to the configuration of said tunnel member carried by said glider.

* * * * *